US006647713B1

(12) United States Patent
Miyajiri et al.

(10) Patent No.: US 6,647,713 B1
(45) Date of Patent: Nov. 18, 2003

(54) STRATIFIED SCAVENGING TWO-CYCLE ENGINE WITH CATALYST

(75) Inventors: Yasutsune Miyajiri, Kawagoe (JP); Toshiharu Sawada, Kawagoe (JP)

(73) Assignee: Komatsu Zenoah Co., Kawagoe (JP)

( * ) Notice: Subject to any disclaimer, the term of this patent is extended or adjusted under 35 U.S.C. 154(b) by 0 days.

(21) Appl. No.: 10/089,748

(22) PCT Filed: Oct. 3, 2000

(86) PCT No.: PCT/JP00/06879

§ 371 (c)(1),
(2), (4) Date: Jul. 15, 2002

(87) PCT Pub. No.: WO01/25604

PCT Pub. Date: Apr. 12, 2001

(30) Foreign Application Priority Data

Oct. 4, 1999 (JP) ..... 11-282699

(51) Int. Cl.[7] ..... F01N 3/10

(52) U.S. Cl. ..... 60/302; 60/299; 60/301; 60/314; 123/73 A; 123/73 C; 123/73 PP

(58) Field of Search ..... 60/299, 301, 302, 60/314, 300, 274; 123/65 R, 73 A, 73 C, 73 PP, 73 R, 65 PE

(56) References Cited

U.S. PATENT DOCUMENTS

| | | | | |
|---|---|---|---|---|
| 4,075,985 A | | 2/1978 | Iwai | 123/73 A |
| 4,924,820 A | * | 5/1990 | Lear et al. | 123/65 PE |
| 5,031,594 A | * | 7/1991 | Morikawa | 123/339 |
| 6,289,856 B1 | * | 9/2001 | Noguchi | 123/73 PP |
| 6,298,811 B1 | * | 10/2001 | Sawada et al. | 123/73 A |
| 6,499,292 B2 | * | 12/2002 | Kato | 60/284 |
| 6,513,464 B1 | * | 2/2003 | Busch | 123/65 VA |

FOREIGN PATENT DOCUMENTS

| | | |
|---|---|---|
| DE | 195 20 944 A1 | 1/1996 |
| JP | 57-183520 A | 11/1982 |
| JP | 60-108530 A | 6/1985 |
| JP | 149716/1986 A | 9/1986 |
| JP | 03-025611 B2 | 4/1991 |
| JP | 3-233127 A | 10/1991 |
| JP | 2603033 B2 | 4/1997 |
| JP | 09-125966 A | 5/1997 |
| JP | 09-268912 A | 10/1997 |
| JP | 11-107761 A | 4/1999 |

* cited by examiner

*Primary Examiner*—Binh Tran
(74) *Attorney, Agent, or Firm*—Sidley Austin Brown & Wood LLP

(57) ABSTRACT

A stratified scavenging two-cycle engine with catalyst capable of meeting such a requirement that a THC exhaust rate is 54 [g/kW·h] or less with use of catalyst. For this purpose, in the stratified scavenging two-cycle engine in which an air feed volume ratio R of an air feed volume (qa) flowing through the air feed passage (24) to a mixture feed volume (Qf) flowing through the mixture feed passage (20) is within a range of $0.7 \leqq R \leqq 1.4$ during an intake stroke in which the crank chamber (8) becomes negative pressure, oxidation catalyst (47) is placed midway in an exhaust passage in a downstream of an exhaust hole (14).

2 Claims, 5 Drawing Sheets

STRATIFIED SCAVENGING TWO-CYCLE ENGINE WITH CATALYST

TECHNICAL FIELD

The present invention relates to a stratified scavenging two-cycle engine, which purifies exhaust gas with use of catalyst.

BACKGROUND ART

Conventionally, in a two-cycle engine, a part of fuel mixture (mixture of fuel and air) supplied into a cylinder is discharged as it is with combustion gas during an exhaust stroke, in its structure. Consequently, unburned gas (mainly containing hydrocarbon HC) is mixed into exhaust gas, which becomes one of the causes of air pollution. As a countermeasure against this, a method of purifying exhaust gas by placing catalyst in an exhaust passage is known.

As a first example thereof, there is an exhaust gas purification device for a two-cycle engine, which is disclosed in, for example, Japanese Patent Laid-open No. 9-268912. According to Japanese Patent Laid-open No. 9-268912, an exhaust passage is connected to an exhaust port open to a cylinder bore, catalyst is placed midway in this exhaust passage, and a variable exhaust timing valve (catalyst protection means) freely opened and closed, which decreases an amount of blow-by gas amount discharged from an exhaust port is provided near the exhaust port. Thereby, the amount of the blow-by gas is reduced by throttling the exhaust port at the time of a low engine speed, exhaust gas is purified, and catalyst is protected.

As a second example, a muffler for an exhaust device of an internal combustion engine, which is disclosed in, for example, Japanese Patent No. 2603033, is known. According to the above Patent, a catalyst converter is provided in the exhaust passage in the muffler, and a reed valve for supplying secondary air blow, which can be opened and closed according to exhaust gas pressure, is provided at a muffler main body in an upstream side of the catalyst converter. Thereby, oxygen concentration in the exhaust gas is increased and purification rate of the catalyst is increased.

However, the above-described prior art has the following disadvantages.

In the exhaust gas purification device disclosed in Japanese Patent Application Laid-open No. 9-268912 of the first example, catalyst is placed in the exhaust passage of an ordinary (specifically, non-stratified scavenging type) two-cycle engine. Consequently, the oxygen concentration in the exhaust gas is low, and the total hydrocarbon purification rate of the catalyst is low. The "total hydrocarbon" includes hydrocarbon HC and nitric oxide NOx, and this will be abbreviated as "THC" hereinafter. The THC purification rate is expressed by the equation "THC purification rate=(THC concentration % before catalyst−THC concentration % after catalyst)×100/THC concentration % before catalyst". Accordingly, exhaust rate of the THC in the exhaust gas is high in the first example, and it is extremely difficult to meet a requirement of "THC exhaust rate≦54 [g/kW·h]" which is expected to be strongly controlled in near future.

In the muffler for the exhaust device of the internal combustion engine disclosed in Japanese Patent 2603033 as the second example, it is necessary to provide a reed valve, whereby there arise the disadvantages that the number of components increases, and as a result, operations of working the opening and mounting the reed valve are added.

DISCLOSURE OF THE INVENTION

In view of the above-described disadvantages, an object of the present invention is to provide a stratified scavenging two-cycle engine with catalyst, which can meet such a requirement that the THC exhaust rate is 54 [g/kW·h] or less with use of the catalyst.

In order to attain the above-described object, a first aspect of the stratified scavenging two-cycle engine with catalyst according to the present invention has a structure in which in a stratified scavenging two-cycle engine including a piston, a cylinder in which the piston is housed slidably up and down, a crankcase connected to a lower end portion of the cylinder and having a crank chamber therein, an exhaust hole and a scavenging hole which are formed in a side wall of the cylinder, a scavenging passage for connecting the scavenging hole and the crank chamber, an air feed passage connected to the scavenging passage and feeding air via a check-valve, and a mixture feed passage for supplying mixture, which is supplied with fuel from fuel feed means, to the crank chamber, and in which an air feed volume ratio R of an air feed volume flowing through the air feed passage to a mixture feed volume flowing through the mixture feed passage is within a range of $0.7 \leqq R \leqq 1.4$ during an intake stroke in which the crank chamber becomes negative pressure, oxidation catalyst is placed midway in an exhaust passage in a downstream of the exhaust hole.

According to the above structure, during the intake stroke in which the crank chamber of the stratified scavenging two-cycle engine becomes negative pressure, the air feed volume ratio R (R=qa/Qf) of the air feed volume qa [$m^3$] flowing through the air feed passage to the mixture feed volume of [$m^3$] flowing through the mixture feed passage is within the range of $0.7 \leqq R \leqq 1.4$. In this situation, as described in detail in Japanese Patent Laid-open No. 11-107761 proposed by the inventors of the present invention, it is confirmed that the exhaust rate of the THC released from the stratified scavenging two-cycle engine is 67 [g/kW·h] or less. Since guiding air pushes out exhaust gas in the stratified scavenging two-cycle engine, the oxygen concentration in the exhaust gas becomes higher as compared with a non-stratified scavenging two-cycle engine, and the amount of hydrocarbon becomes one third. The inventors of the present invention confirm that if the oxidation catalyst is placed midway in the exhaust passage provided in the downstream of the exhaust hole of the stratified scavenging two-cycle engine, reheat combustion of hydrocarbon is promoted since the oxygen concentration in the exhaust gas is high, and the purification rate of the catalyst is improved so that the THC exhaust rate becomes 40 [g/kW·h] or less. Consequently, the target to reduce the THC exhaust rate to 54 [g/kW·h] or less can be. sufficiently attained. Since the hydrocarbon volume in the exhaust gas becomes one third, the heating value as a result of the reaction of the oxidation catalyst with hydrocarbon reduces, and therefore abnormal rise in temperature is prevented, thus making it possible to improve durability of the oxidation catalyst. Further, rise in temperature of the exhaust gas is reduced. Rise in temperature of the engine itself becomes less, and reduction in durability due to overheating and the like can be prevented. At the same time, heating value of the oxidation catalyst is small, and sufficient purification can be carried out by small-sized catalyst, thus making it possible to reduce the size of the entire engine apparatus. Furthermore, since it is not necessary to provide a reed valve as in the prior arts, the number of components can be reduced and a working operation for the opening for the reed valve becomes unnecessary.

A second aspect of the stratified scavenging two-cycle engine according to the present invention has a structure in which in a stratified scavenging two-cycle engine including a piston, a cylinder in which the piston is housed slidably up and down, a crankcase connected to a lower end portion of the cylinder and having a crank chamber therein, an exhaust hole and a scavenging hole which are formed in a side wall of the cylinder, a scavenging passage for connecting the scavenging hole and the crank chamber, an air feed passage connected to the scavenging passage and feeding air via a check-valve, and a mixture feed passage for supplying mixture supplied with fuel from fuel feed means to the crank chamber, and in which the scavenging passage is formed in the cylinder, or the cylinder and the crankcase, and a scavenging passage volumetric capacity formed by the formed scavenging passage and the check-valve of the air feed passage is 70% or more relative to an air feed volume flowing through the air feed passage during an intake stroke in which the crank chamber becomes negative pressure at the time of full load rated power engine speed, the oxidation catalyst is placed midway in an exhaust passage in a downstream of the exhaust hole.

According to the above structure, the scavenging passage is provided in the cylinder of the stratified scavenging two-cycle engine, or in the cylinder and the crankcase, and the scavenging passage volumetric capacity Vs [$m^3$] formed by this scavenging passage and the check-valve of the air feed passage is 70% or more relative to the air feed volume qa [$m^3$] flowing through the air feed passage during the intake stroke in which the crank chamber becomes negative pressure at the time of the full load rated power engine speed. In this situation, as described in detail in the above-described Japanese Patent Application Laid-open No. 11-107761, it is confirmed that the exhaust rate of the THC discharged from the stratified scavenging two-cycle engine is 54 [g/kW·h] or less. As described above, the oxygen concentration becomes high and hydrocarbon amount becomes less in the exhaust gas in the stratified scavenging two-cycle engine. As a result, by placing the oxidation catalyst midway in the exhaust passage of the stratified scavenging two-cycle engine as described above, the THC exhaust rate becomes 40 [g/kW·h] or less, whereby the target to make the THC exhaust rate 54 [g/kW·h] or less can be sufficiently attained. The inventors of the present invention confirms this fact as a result of the experiments and the like. In addition, by this structure, the durability of the engine and the oxidation catalyst can be improved, and sufficient purification can be performed by small-sized catalyst, and the entire engine apparatus can be made compact. Furthermore, since it is not necessary to provide a reed valve as in the prior arts, the number of the components is small, and the working operation for the opening for the reed valve is not needed.

Further, by combining the above-described first structure and the second structure, more favorable effects can be obtained. As described in detail in Japanese Patent Application Laid-open No. 11-107761, it is confirmed that the exhaust rate of the THC of the stratified scavenging two-cycle engine according to the above-described first and second structure is 67 [g/kW·h] or less. The present applicant confirms that the THC exhaust rate becomes 40 [g/kW·h] or less by placing the oxygen catalyst midway in the exhaust passage of the stratified scavenging two-cycle engine, and consequently, the target can be sufficiently attained.

BEST MODE FOR CARRYING OUT THE INVENTION

Preferred embodiments of a stratified scavenging two-cycle engine with catalyst according to the present invention will be described in detail below with reference to the attached drawings.

Figure 1:
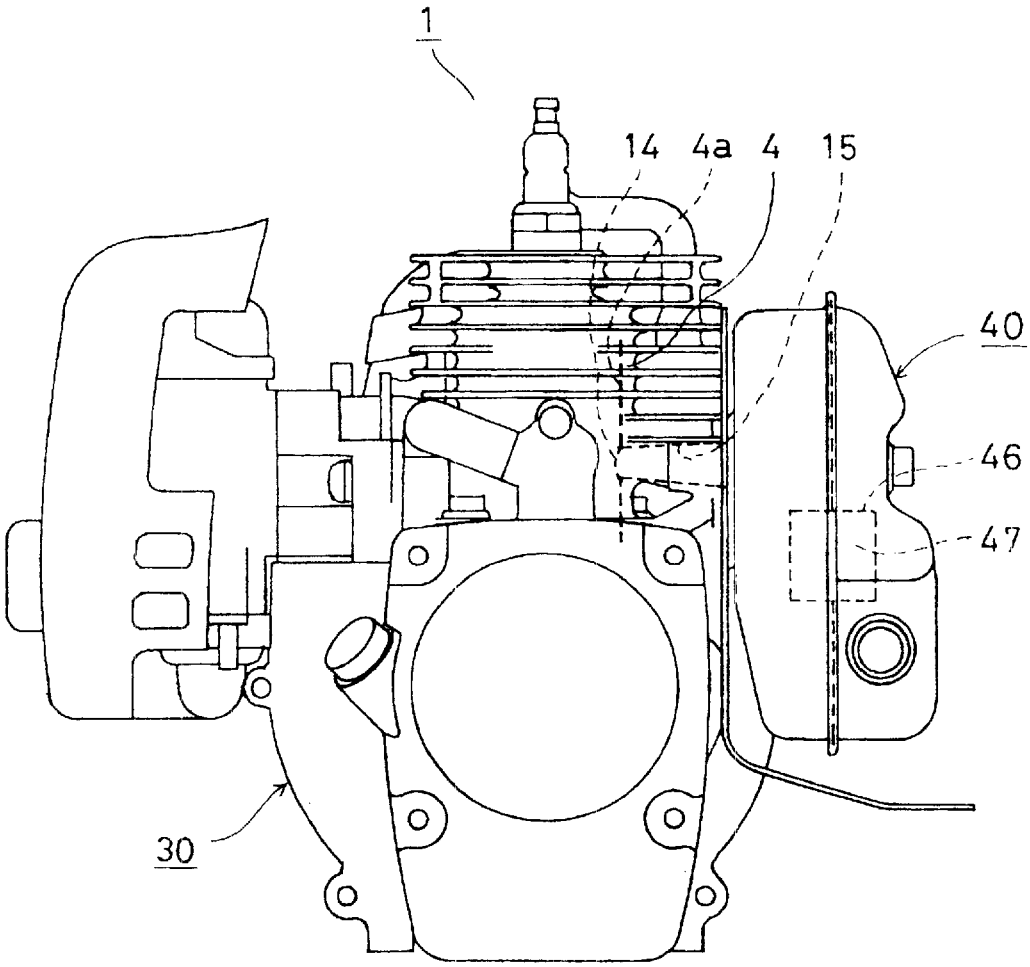
FIG. 1 is a side view of a stratified scavenging two-cycle engine with catalyst according to the present invention.

FIG. 1 is a side view of a stratified scavenging two cycle engine 1 with catalyst. The stratified scavenging two cycle engine 1 with catalyst 1 has a stratified scavenging two cycle engine 30 and a silencer 40 with catalyst. Specifically, the silencer 40 with catalyst is attached at an outlet of an exhaust passage 15 connecting to an exhaust hole 14 provided at a side wall 4*a* of a cylinder 4 of the stratified scavenging two-cycle engine 30. The silencer 40 with catalyst is provided with a metal honeycomb 46 a surface of which is coated with oxidation catalyst 47 therein.

Figure 2:
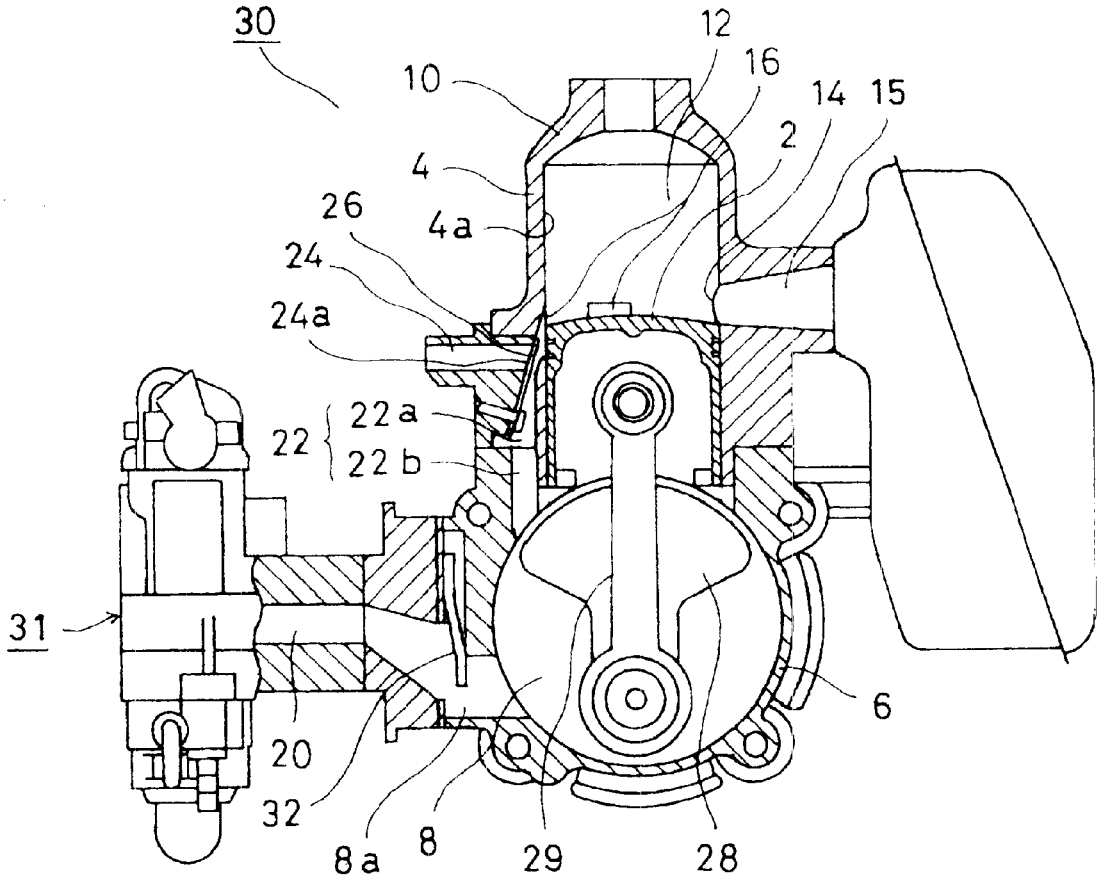
FIG. 2 is a sectional side view showing a structure of a stratified scavenging two-cycle engine according to the present invention.

FIG. 2 is an sectional side view showing a schematic block diagram of the stratified scavenging two-cycle engine 30 that is used in the present invention. A piston 2 is closely housed in the cylinder 4 slidably up and down. A crankcase 6 is connected to a lower end portion of the cylinder 4, and a crank chamber 8 is formed in the crankcase 6. A cylinder head 10 is connected to an upper end portion of the cylinder 4. The piston 2, the cylinder 4 and the cylinder head 10 form a cylinder chamber 12 in which mixture is supplied, combusted and exploded. In the side wall 4*a* of the cylinder 4, provided are the exhaust hole 14 for discharging combustion gas after combustion and explosion, and a scavenging hole 16 for supplying mixture after guiding air is supplied into the cylinder chamber 12 at the beginning of a scavenging stroke and forces out combustion gas. The exhaust hole 14 communicates with an outside through the exhaust passage 15. The scavenging hole 16 communicates with the crank chamber 8 through a scavenging passage 22. The scavenging passage 22 is formed by a passage 22*a* provided in the side wall 4*a* of the cylinder 4, and a hole 22*b*, which communicates with the passage 22*a*, and is surrounded by a channel provided in the crankcase 6 and a lower outer circumferential surface of the cylinder 4 extendedly provided downward from an upper end surface of the crankcase 6.

An air feed passage 24 is connected to the scavenging passage 22 for connecting the cylinder 4 and the crankcase 6. A check-valve 26 for allowing a flow of air from the air feed passage 24 to the scavenging passage 22 and for inhibiting a flow in the opposite direction is provided at a connecting portion 24*a* of the scavenging passage 22 and the air feed passage 24. The connecting portion 24*a* is located at an upper part of the scavenging passage 22 so that the scavenging passage 22 is filled with air supplied from the air feed passage 24. A scavenging passage volumetric capacity Vs formed in the scavenging passage 22 means a volumetric capacity surrounded by the passage 22*a* of the cylinder 4, the hole 22*b* of the crankcase 6, and the check-valve 26 formed in the air feed passage 24.

A crank 28 connected to the piston 2 via a connecting rod 29 is rotatably housed in the crankcase 6, thereby forming the crank chamber 8. The crankcase 6 is provided with a mixture inlet hole 8*a*, and a mixture feed passage 20 is connected to the mixture inlet hole 8*a*. A fuel feed device 31 for supplying liquid fuel such as gasoline and generating mixture is placed in the mixture feed passage 20. An mixture check valve 32 for allowing only a flow to the crank chamber 8 from the mixture feed passage 20 and inhibiting an opposite flow is placed at a connecting portion of the mixture feed passage 20 and the mixture inlet hole 8*a*.

Here, assume that at the time of an inlet stroke, a ratio of an air volume to a mixture volume which are supplied to the scavenging passage 22 and the crank chamber 8, specifically, a ratio of an air feed volume qa [$m^3$] flowing through the air feed passage 24 to a mixture feed volume Qf [$m^3$] flowing through the mixture feed passage 20 is an air feed volume ratio R (R=qa/Qf). The air teed volume ratio R is set to be $0.7 \leqq R \leqq 1.4$, and is preferably set to be $0.8 \leqq R \leqq 1.2$. As a result, as explained in Japanese Patent Application Laid-open No. 11-107761, it is confirmed that a THC exhaust rate meets a requirement of 67 [g/kW·h] or less when the air feed volume ratio R is in a range of $0.7 \leqq R \leqq 1.4$, and the THC exhaust rate meets a requirement of 47 [g/kW·h] or less when it is within a range of $0.8 \leqq R \leqq 1.2$. A scavenging passage volumetric capacity Vs [$m^3$] of the scavenging passage 22 to the air feed volume qa [$m^3$] is set to be 70% or more, and is preferably 80% or more. In this case, as explained in Japanese Patent Application Laid-open No. 11-107761, it is confirmed that when the scavenging passage volumetric capacity Vs [$m^3$] to the air feed volume qa [$m^3$] is 70% or more, the THC exhaust rate meets a requirement of 67 [g/kW·h] or less, and when it is 80% or more, the THC exhaust rate meets a requirement of 47 [g/kW·h] or less.

Figure 3:
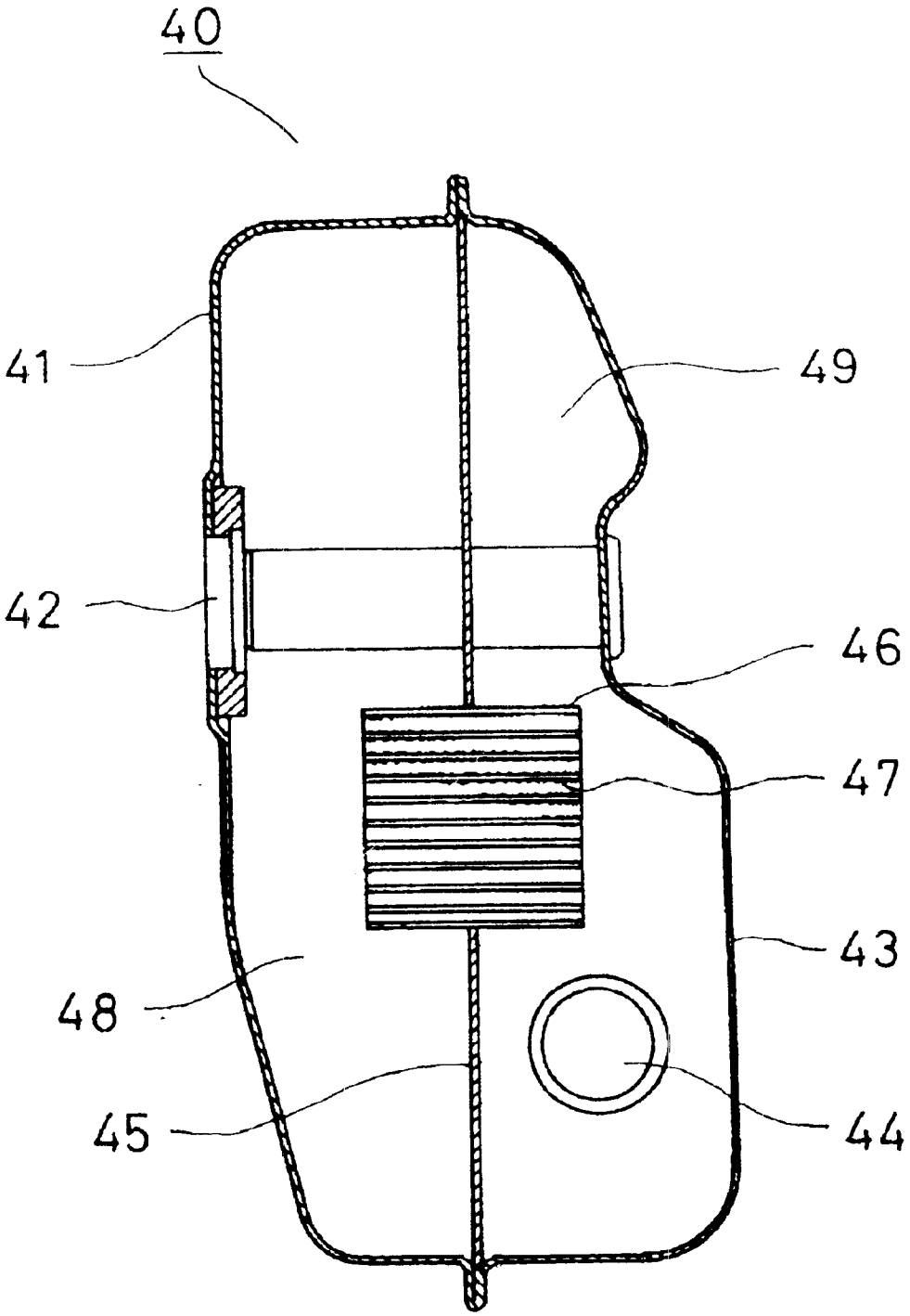
FIG. 3 is a sectional view of a silencer with catalyst of a first embodiment of the present invention.

FIG. 3 is a sectional view of the silencer 40 with catalyst in the first embodiment which is attached to the stratified scavenging two-cycle engine 1 with catalyst. The silencer 40 with catalyst includes a first outer plate 41 having an inlet port 42 connecting to the exhaust passage 15 (see FIG. 2) of the stratified scavenging 2-cycle engine 30, a second outer plate 43 having an exhaust port 44, a partition wall 45 and a metal honeycomb 46 attached to the partition wall 45. A surface of the metal honeycomb 46 is coated with oxidation catalyst 47 composed of platinum and rhodium, platinum and palladium, or platinum, rhodium, palladium and the like. The first outer plate 41 and the partition wall 45 form a first chamber 48, and a second outer plate 43 and the partition wall 45 form a second chamber 49. Exhaust gas discharged from the exhaust passage 15 enters the first chamber 48 from the inlet port 42, passes through the metal honeycomb 46, and discharged into the atmosphere from the discharge port 44 via the second chamber 49. The exhaust gas is purified as the THC is oxidized by the oxidation catalyst 47 of the surface of the metal honeycomb 46.

Figure 4:
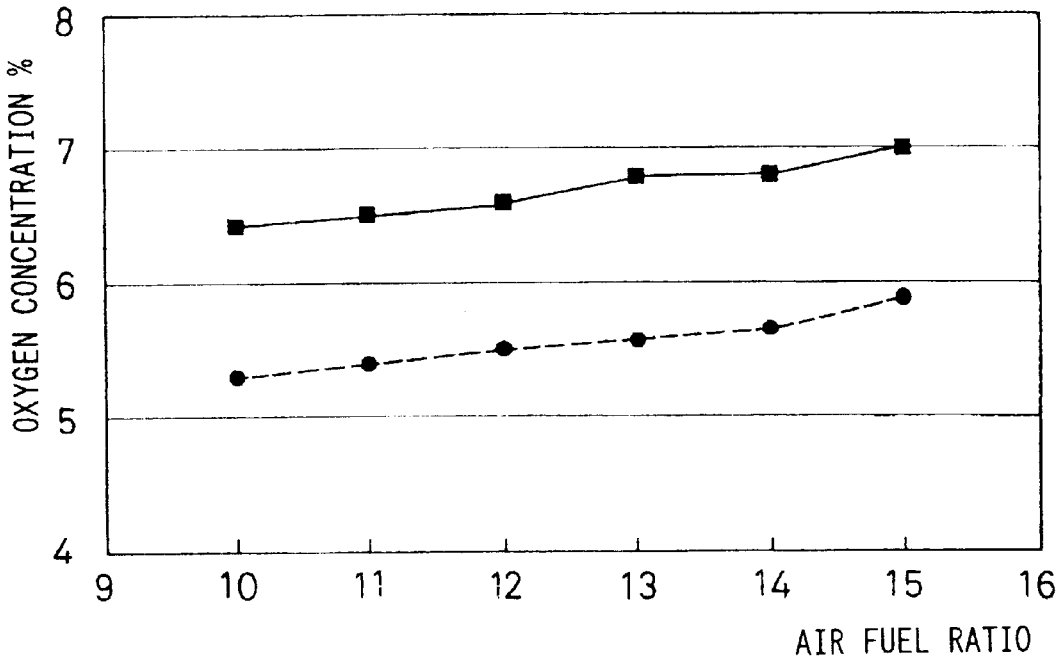
FIG. 4 is a diagram showing an oxygen concentration characteristic in exhaust gas of the stratified scavenging two-cycle engine according to the present invention.

Next, exhaust gas purification performance of the stratified scavenging two-cycle engine 1 with catalyst will be explained. FIG. 4 is a diagram showing an oxygen concentration characteristic in the exhaust gas of the stratified scavenging two-cycle engine 30 used in the stratified scavenging two-cycle engine 1 with catalyst, the horizontal axis shows air-fuel ratio and the vertical axis shows oxygen concentration. In FIG. 4, the solid line shows the oxygen concentration of the stratified scavenging two-cycle engine 30 of the present invention, and the broken line shows the oxygen concentration of a conventional non-stratified scavenging two-cycle engine. As shown in FIG. 4, in the stratified scavenging two-cycle engine 30 having the aforementioned characteristic, exhaust gas is pushed out with the guiding air, and therefore the oxygen concentration in the exhaust gas shows a higher value as compared with the oxygen concentration of the non-stratified scavenging two-cycle engine.

Figure 5:
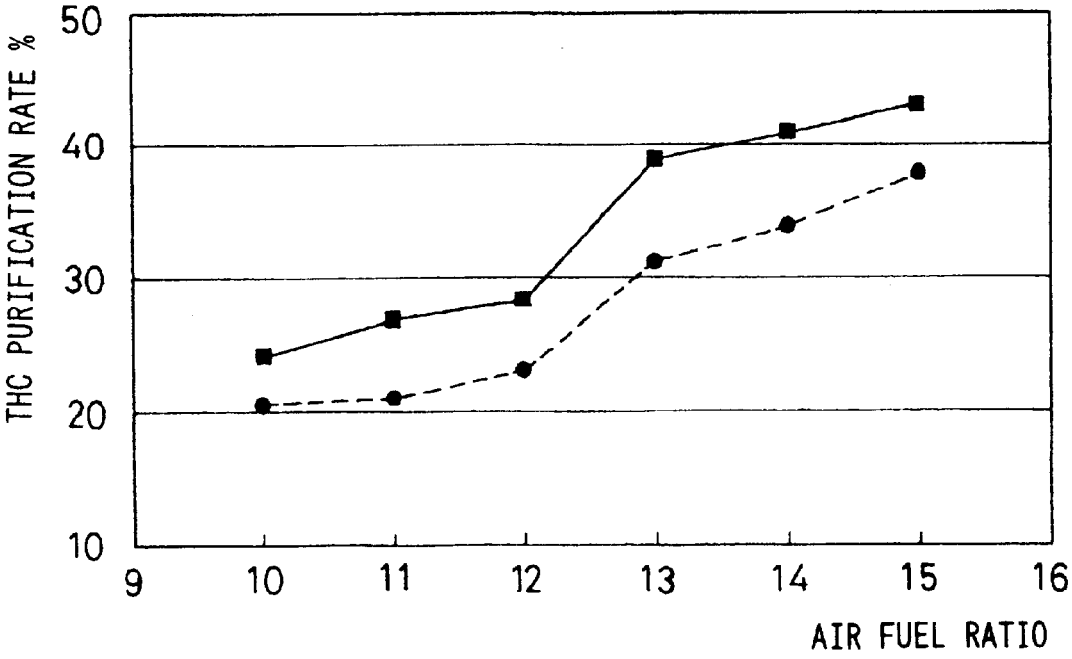
FIG. 5 is a diagram of a THC purification characteristic of catalyst of the stratified scavenging two-cycle engine according to the present invention.

FIG. 5 is a diagram showing a purification characteristic of the oxidation catalyst 47 for the THC in the stratified scavenging two-cycle engine 1 with catalyst constructed by placing the oxidation catalyst 47 on the exhaust passage of the stratified scavenging two-cycle engine 30, the horizontal axis shows an air fuel ratio, and the vertical axis shows the THC purification rate. In FIG. 5, the solid line shows the purification rate of the oxidation catalyst 47 of the stratified scavenging two-cycle engine 1 with catalyst, and the broken line shows the purification rate of the catalyst when the conventional non-stratified scavenging two-cycle engine is provided with catalyst. As shown in FIG. 5, the purification rate of the catalyst of the stratified scavenging two-cycle engine 1 with catalyst is improved since the oxygen concentration in the exhaust gas is high as shown in FIG. 4, and reheat combustion of hydrocarbon is promoted to increase purification rate. As a result, at an equal air-fuel ratio, the purification rate shows a higher value by a few percent to about 8% as compared with the purification rate of the catalyst of the non-stratified scavenging two-cycle engine. Normally, the air-fuel ratio is 13 to 14 in the case of the stratified scavenging two-cycle engine 30, and it is 11 to 12 in the case of the non-stratified scavenging two-cycle engine. Accordingly, the purification rate is about 40% in the case of the stratified scavenging two-cycle engine 30, and about 23% in the case of the non-stratified scavenging two-cycle engine. As described above, according to the present invention, the purification rate can be increased by 15% or more as compared with the purification rate of the non-stratified scavenging two-cycle engine.

As described above, by using the stratified scavenging two-cycle engine according to the present invention, the oxygen concentration in the exhaust gas is increased as compared with the non-stratified scavenging two-cycle engine, and therefore the hydrocarbon volume is decreased. As a result, heating value of the oxidation catalyst can be reduced, and the purification characteristic of the THC can be improved. Accordingly, sufficient purification becomes possible even with small-sized oxidation catalyst, the exhaust passage can be made shorter, and thus a small-sized silencer can be used. For example, in the case of the two-cycle engine with a capacity of, for example, $22.5 \times 10^{-3}$ [liter], in the stratified scavenging engine, the size of the metal honeycomb 46 shown in FIG. 3 may be in the form of a cylinder with a diameter of $20 \times 10^{-3}$ [m]×length of $20 \times 10^{-3}$ [m], and the capacity of the silencer 40 with catalyst may be about $190 \times 10^{-6}$ [$m^3$]. On the other hand, in the case of the non-stratified scavenging engine, the size of the metal honeycomb needs to be in the form of a cylinder with a diameter of $30 \times 10^{-3}$ [m]×length of $30 \times 10^{-3}$ [m], and the capacity of the silencer with catalyst needs to be about $250 \times 10^{-6}$ [$m^3$] for the engine of the same capacity as above.

As described in detail in the above, the stratified scavenging two-cycle engine 1 with catalyst of the present invention has the oxidation catalyst 47 placed in the exhaust passage of the stratified scavenging two-cycle engine 30, and therefore the following effects are provided.

(1) When the air feed volume ratio R of the stratified scavenging two-cycle engine 30 is within $0.7 \leqq R \leqq 1.4$, and/or the scavenging flow passage volumetric capacity Vs/the air feed volume qa is 70% or more, the THC exhaust rate when the oxidation catalyst is not provided is 67 [g/kW·h] or less and the purification rate by the oxidation catalyst 47 is about 40% (see FIG. 5), from which the THC exhaust rate is found by the equation "67 [g/kW·h]×(1−0.4)", and the value is about 40 [g/kW·h].

When the air feed volume ratio R is within the range of $0.8 \leqq R \leqq 1.2$, and/or the scavenging passage volumetric capacity Vs/the air feed volume qa is 80% or more, the THC exhaust rate when the oxidation catalyst is not provided is 47 [g/kW·h] or less, and the purification rate by the oxidation catalyst is about 40%, from which the THC exhaust rate is found by the equation "47 [g/kW·h]×(1−0.4)", and the value is about 28 [g/kW·h]. Accordingly, the target can be sufficiently met.

(2) As a result of using the stratified scavenging type, the hydrocarbon volume before catalyst becomes one third as compared with the non-stratified scavenging engine, and the heating value of the oxidation catalyst can be reduced. In addition, the purification rate of the THC is improved. As a result, a) abnormal rise in temperature of the oxidation catalyst can be prevented, and durability of the oxidation catalyst is improved.

b) rise in the exhaust gas temperature is smaller as compared with the non-stratified scavenging engine.

c) rise in the temperature of the engine itself caused by heat transfer from a muffler can be reduced, and reduction in durability of the engine due to overheating and the like can be prevented.

d) the purpose of purification can be effected with small-sized oxidation catalyst.

(3) The exhaust passage can be made shorter since the rise in the exhaust gas temperature is small, and the silencer can be made compact. Accordingly, coupled with reduction in size of the oxidation catalyst, the entire engine device can be made compact.

Figure 6:
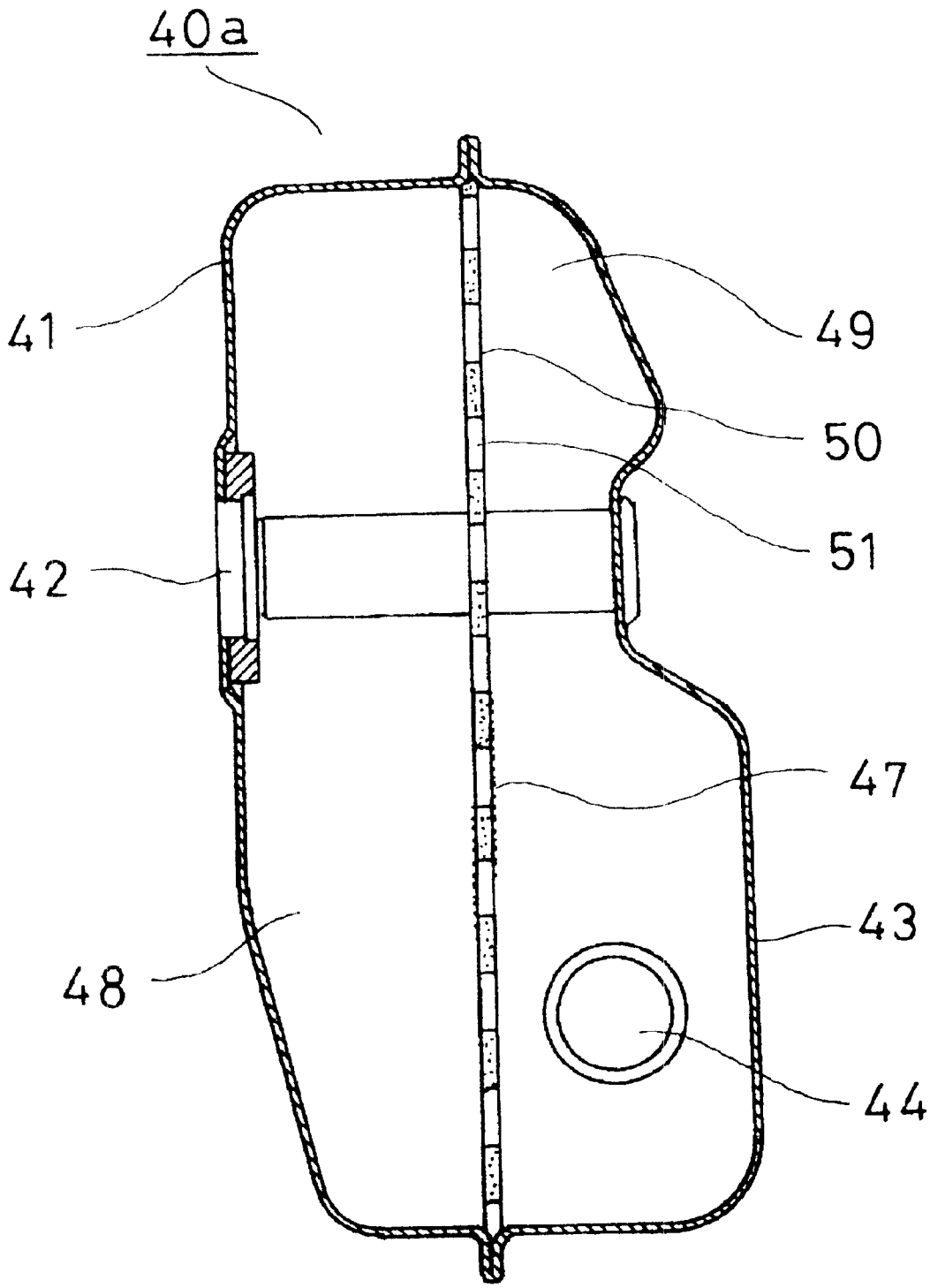
FIG. 6 is a sectional view of a silencer with catalyst of a second embodiment of the present invention.

FIG. 6 is a sectional view of a silencer 40*a* with catalyst of a second embodiment. The same elements as in the first embodiment are given the same reference numerals to omit the explanation thereof, and only the different part will be explained.

A baffle plate 50 is attached between the first outer plate 41 and the second outer plate 43. The baffle plate 50 is provided with a plurality of exhaust passage holes 51, and a surface of the baffle plate 50 is coated with the oxidation catalyst 47. The exhaust gas passes through an exhaust passage hole 51 of the baffle plate 50 from the first chamber 48, then it is purified by the oxidation catalyst 47, reaches the second chamber 49 and is discharged into the atmosphere from the exhaust port 44. The operation and effects of the second embodiment are the same as those in the first embodiment, and therefore the explanation thereof will be omitted.

INDUSTRIAL AVAILABILITY

The present invention is useful as a stratified scavenging two-cycle engine with catalyst which can meet such a requirement that the THC exhaust rate is 54 [g/kW h] or less with use of catalyst.

What is claimed is:

1. A stratified scavenging two-cycle engine comprising a piston, a cylinder in which said piston is housed slidably up and down, a crankcase connected to a lower end portion of said cylinder and having a crank chamber therein, an exhaust hole and a scavenging hole which are formed in a side wall of said cylinder, a scavenging passage for connecting said scavenging hole and said crank chamber, an air feed passage connected to said scavenging passage and feeding air via a check-valve, and a mixture feed passage for supplying mixture supplied with fuel from fuel feed means to said crank chamber, in which an air feed volume ratio R of an air feed volume (qa) flowing through said air feed passage to a mixture feed volume (Qf) flowing through said mixture feed passage is within a range of $0.7 \leqq R \leqq 1.4$ during an intake stroke in which said crank chamber becomes negative pressure, wherein oxidation catalyst is placed midway in an exhaust passage in a downstream of said exhaust hole.

2. A stratified scavenging two-cycle engine comprising a piston, a cylinder in which said piston is housed slidably up and down, a crankcase connected to a lower end portion of said cylinder and having a crank chamber therein, an exhaust hole and a scavenging hole which are formed in a side wall of said cylinder, a scavenging passage for connecting said scavenging hole and said crank chamber, an air feed passage connected to said scavenging passage and feeding air via a check-valve, and a mixture feed passage for supplying mixture supplied with fuel from fuel feed means to said crank chamber, in which said scavenging passage is formed in said cylinder, or said cylinder and said crankcase, and scavenging passage volumetric capacity (Vs) formed by said formed scavenging passage and the check-valve of said air feed passage is 70% or more relative to an air feed volume (qa) flowing through said air feed passage during an intake stroke in which said crank chamber becomes negative pressure at full load rated power engine speed, wherein oxidation catalyst is placed midway in an exhaust passage in a downstream of said exhaust hole.

* * * * *